US009464813B2

(12) United States Patent
Sano et al.

(10) Patent No.: US 9,464,813 B2
(45) Date of Patent: Oct. 11, 2016

(54) COOKING DEVICE

(75) Inventors: Masaaki Sano, Kyoto (JP); Satoshi Arima, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 325 days.

(21) Appl. No.: 13/202,899

(22) PCT Filed: Apr. 26, 2010

(86) PCT No.: PCT/JP2010/002970

§ 371 (c)(1),
(2), (4) Date: Aug. 23, 2011

(87) PCT Pub. No.: WO2010/125786

PCT Pub. Date: Nov. 4, 2010

(65) Prior Publication Data

US 2011/0303652 A1 Dec. 15, 2011

(30) Foreign Application Priority Data

Apr. 27, 2009 (JP) ..... 2009-107573

(51) Int. Cl.
*H05B 6/12* (2006.01)
*F24C 7/08* (2006.01)
*F24C 15/02* (2006.01)

(52) U.S. Cl.
CPC ..... *F24C 7/082* (2013.01); *F24C 15/02* (2013.01)

(58) Field of Classification Search
CPC ..... H05B 6/666; H05B 6/6438
USPC ..... 219/622, 702, 712, 713, 714, 715
See application file for complete search history.

(56) References Cited

U.S. PATENT DOCUMENTS 5,786,996 A * 7/1998 Vitkus ..... G05B 19/0428 219/413
6,043,461 A * 3/2000 Holling et al. ..... 219/445.1
7,326,888 B2 2/2008 Chun et al.
7,351,941 B2 4/2008 Kim
7,361,866 B2 4/2008 Chun
7,473,869 B2 1/2009 Chun
7,514,658 B2 4/2009 Kim (Continued)

FOREIGN PATENT DOCUMENTS

CN 1573220 A 2/2005
CN 1578261 A 2/2005

(Continued)

OTHER PUBLICATIONS

Extended European Search Report for European Application No. 10769486.1, dated Aug. 21, 2012, 6 pages.

(Continued)

*Primary Examiner* — Dana Ross
*Assistant Examiner* — Ayub Maye
(74) *Attorney, Agent, or Firm* — Brinks Gilson & Lione

(57) ABSTRACT

Device body (2) with heating chamber (4), and door (3) that opens and closes opening (5) of heating chamber (4). A door wireless communication unit (17) transmits a control signal from an operation unit provided on door 3 in the form of a wireless signal to main wireless communication unit (19). This configuration eliminates the need of wiring between the operation unit and device body (2). No wiring improves noise resistance and productivity.

13 Claims, 5 Drawing Sheets

(56) References Cited

U.S. PATENT DOCUMENTS

| | | | | |
|---|---|---|---|---|
| 7,724,204 | B2 * | 5/2010 | Annamaa et al. | 343/906 |
| 7,782,205 | B1 * | 8/2010 | Gakumura et al. | 340/572.1 |
| 2005/0002471 | A1 * | 1/2005 | Tramm | H04L 27/2039 375/308 |
| 2005/0011886 | A1 | 1/2005 | Kim | |
| 2005/0016996 | A1 | 1/2005 | Chun | |
| 2006/0289498 | A1 | 12/2006 | Chun | |
| 2006/0289499 | A1 | 12/2006 | Chun | |
| 2007/0029306 | A1 | 2/2007 | Chun et al. | |
| 2007/0187396 | A1 | 8/2007 | Kim | |

FOREIGN PATENT DOCUMENTS

| | | | | |
|---|---|---|---|---|
| CN | 1900858 | A | 1/2007 | |
| CN | 101197507 | A | 6/2008 | |
| DE | 20207052 | U1 | 8/2002 | |
| EP | 1974650 | A2 | 10/2008 | |
| FR | 2906875 | A1 | 4/2008 | |
| JP | 60-140814 | U | 9/1985 | |
| JP | 02-230026 | A | 9/1990 | |
| JP | 04-121520 | A | 4/1992 | |
| JP | 2000-279148 | A | 10/2000 | |
| JP | 3076649 | U | 1/2001 | |
| JP | 2004-219007 | A | 8/2004 | |
| JP | 2004219007 | A * | 8/2004 | F24C 3/12 |
| JP | 2004-353907 | A | 12/2004 | |
| JP | 2005-135718 | A | 5/2005 | |
| JP | 2006-057955 | A | 3/2006 | |
| JP | 2007081512 | A * | 3/2007 | |
| JP | 2007-292454 | A | 11/2007 | |
| JP | 2007-336710 | A | 12/2007 | |
| JP | 2009-124895 | A | 6/2009 | |
| WO | WO 97/26486 | A1 | 7/1997 | |
| WO | WO 2008/118999 | A2 | 10/2008 | |
| WO | WO 2008118999 | A2 * | 10/2008 | F24C 7/08 |

OTHER PUBLICATIONS

International Search Report for International Application No. PCT/JP2010/002970, dated Jul. 13, 2010, 5 pages.

* cited by examiner

COOKING DEVICE

This application is a 371 application of PCT/JP2010/002970 having an international filing date of Apr. 26, 2010, which claims priority to JP2009-107573 filed Apr. 27, 2009, the entire contents of which are incorporated herein by reference.

TECHNICAL FIELD

The present invention relates to cooking devices in which an operation unit is provided on a door.

BACKGROUND ART

A cooking device such as a microwave oven and cooking range has an operation unit where cooking switches are provided. A floor-standing cooking device disclosed in PTL 1 has an operation unit on a door for opening and closing a heating chamber.

FIG. 4 is a perspective view of the cooking device of PTL 1. Cooking device 100 includes device body 102 with heating chamber 101, and door 103 that opens and closes an opening of heating chamber 101. Handle 104 is provided at an upper part of door 103 in the state door 103 is closed. Handle 104 has operation unit 105. FIG. 5 is a sectional view of handle 104. Cooking switch 106 is provided on operation unit 105.

This conventional cooking device 100 does not have operation unit 105 on device body 102. This allows an increase of the capacity of heating chamber 101. In addition, this conventional cooking device 100 is placed on a floor. Accordingly, a user can operate from above operation unit 105 on handle 104 provided at the upper part of device body 102. This improves user friendliness of cooking switch 106.

However, operation unit 105 is provided on an upper part of door 103 in this conventional cooking device 100. Signal line 107 connecting operation unit 105 and a controller (not illustrated) provided in device body 102 is wired from the upper part of door 103 to the controller through hinge 108 at a lower part of door 103. In other words, a wiring distance of signal line 107 is long. Signal line 107 is thus easily affected by noise due to a long wiring distance of signal line 107. In addition, the long wiring distance of signal line 107 results in low productivity at manufacturing cooking device 100.

[PTL 1] Japanese Patent Unexamined Publication No. H2-230026

SUMMARY OF THE INVENTION

The present invention solves aforementioned disadvantage of the prior art, and offers a cooking device with good noise resistance and productivity.

The cooking device of the present invention includes a device body with a heating chamber, a heating unit for heating an object to be heated placed in the heating chamber, a door that opens and closes an opening of the heating chamber, and an operation unit that is provided on the door and outputs a control signal corresponding to a designated cooking menu. The cooking device of the present invention further includes a door wireless communication unit that is provided on the door and transmits a control signal in the form of wireless signal from the operation unit, and a main wireless communication unit that receives the wireless signal from the door wireless communication unit and transmits the wireless signal in the form of a control signal to a controller for controlling the heating unit.

This configuration enables two-way wireless communication between the operation unit and the device body, and eliminates wiring. No wiring improves noise resistance and productivity.

DETAILED DESCRIPTION OF THE PREFERRED EMBODIMENTS

Exemplary embodiments of the present invention are described below with reference to drawings.

First Exemplary Embodiment

Figure 1:
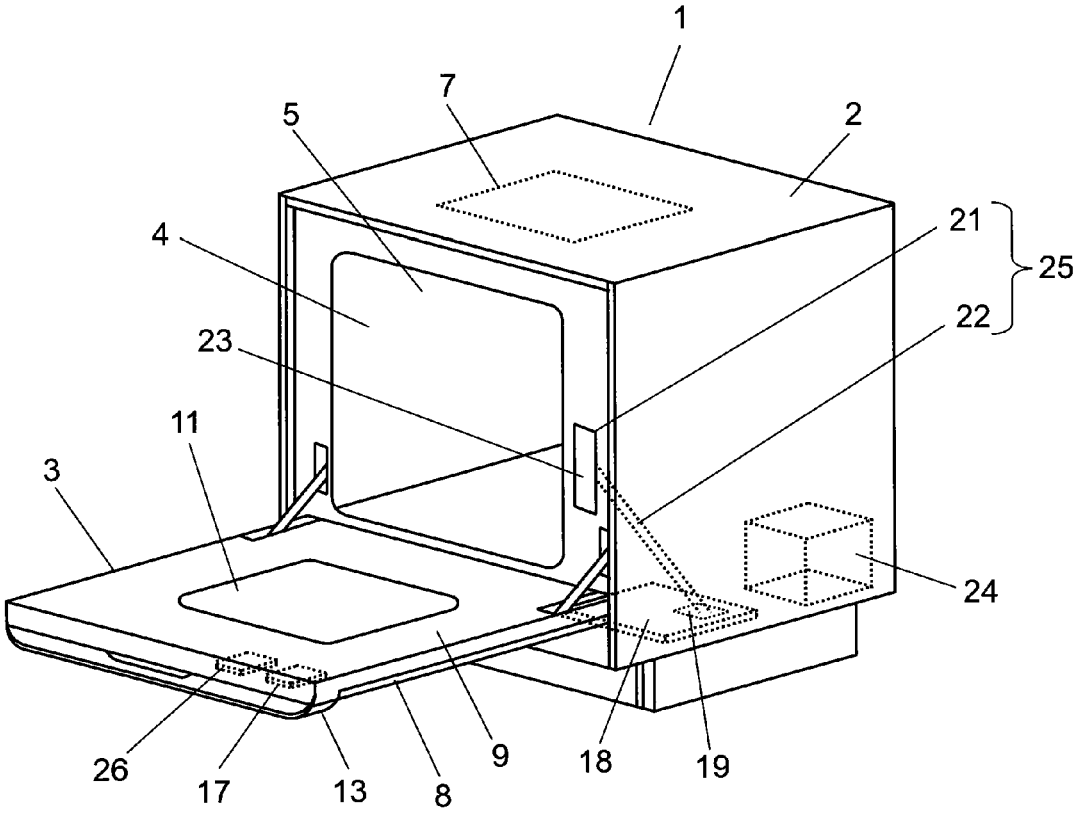
FIG. 1 is a perspective view of a cooking device in accordance with a first exemplary embodiment of the present invention.
Figure 2:
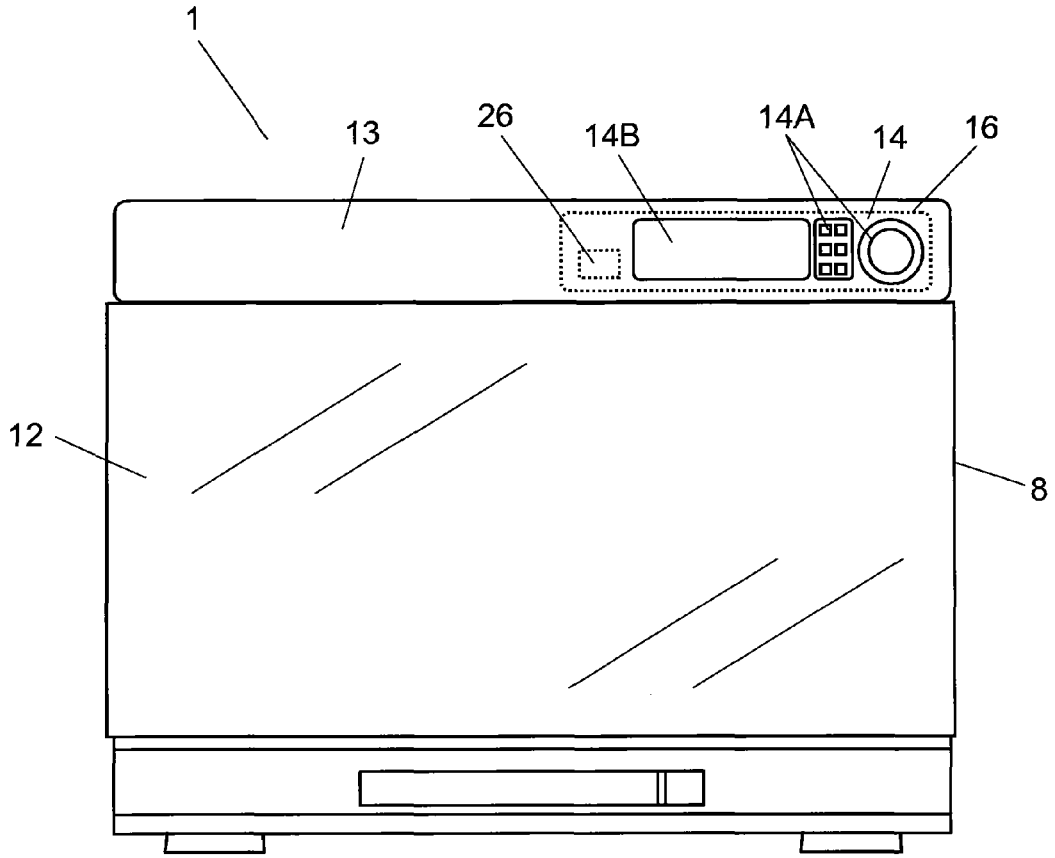
FIG. 2 is a front view of the cooking device in the first exemplary embodiment of the present invention.

FIG. 1 is a perspective view of a cooking device in the first exemplary embodiment of the present invention. FIG. 2 is a front view of the cooking device in this exemplary embodiment.

As shown in FIG. 1, cooking device 1 includes device body 2 whose exterior is covered with a metal plate, and door 3. Heating chamber 4 with opening 5 at the front is provided inside device body 2. Opening 5 of heating chamber 4 is opened and closed by door 3. Door 3 is axially supported at its bottom end, and opens and closes in the vertical direction. Door 3 also covers the entire front face of device body 2.

Magnetron 24 that generates microwaves of 2450 MHz, which are high-frequency waves, is provided as a heating unit at a lower part of heating chamber 4. Heater 7 is provided on a ceiling of heating unit 4 as another heating unit. An object to be heated inside heating chamber 4 is heated by high-frequency waves of magnetron 24 and radiation heat of heater 7. The object to be heated is cooked by this heating.

Next, a structure of door 3 is described. Door 3 includes door outer wall 8 that becomes an outer face of cooking device 1 when door 3 is closed, and door inner wall 9 that faces heating chamber 4 when door 3 is closed. Door 3 has a double-walled structure with space between door outer wall 8 and door inner wall 9. Glass window 11 with an area slightly smaller than opening 5 of heating chamber 4 and a resin frame (not illustrated) surrounding glass window 11 are provided on door inner wall 9. A porous plate (not illustrated) for shielding high-frequency waves is provided on glass window 11. When door 3 is closed, the outer periphery of door inner wall 9 blocks the entire periphery of opening 5 of heating chamber 4.

As show in FIG. 2, transparent window 12 for looking inside heating chamber 4 from outside cooking device 1 is provided on door outer wall 8. In FIG. 2, transparent window 12 is configured with a glass sheet covering the entire front face of door 3. Handle 13 that is held by the user for opening and closing door 3 is provided at an upper part of door outer wall 8, which is an upper part of door 3. Handle 13 protrudes to the front from door 3. Operation unit 14 with multiple cooking switches 14A is provided at the right side of handle 13. Cooking switches 14A are used for executing or stopping a range of cooking menus. Operation unit 14 further includes display 14B for displaying time required until completion of cooking, temperature inside heating chamber, and so on.

Cooking switches 14A are provided on substrate 16 embedded inside door outer wall 8. Cooking switches 14A are operated by pressing door outer wall 8 from outside. Door wireless communication unit 17 with antenna (not illustrated) is provided on substrate 16. In other words, door wireless communication unit 17 is provided on handle 13. Door wireless communication unit 17 outputs a control signal from cooking switches 14A in the form of a wireless signal of radio wave. Door wireless communication unit 17 has a structure of outputting the wireless signal toward device body 2.

Controller 18 is provided inside device body 2. Controller 18 receives a control signal from cooking switch 14A, and gives a command to door wireless communication unit 17 to output a wireless signal corresponding to cooking switch 14A.

Main wireless communication unit 19 outputs the wireless signal received from door wireless communication unit 17 to controller 18. Controller 18 outputs a control signal for driving magnetron 24, heater 7, cooling fan (not illustrated) of magnetron, and so on Hole 21 is provided on a rim around opening 5 of device body 2 so as to pass through radio waves transmitted from door wireless communication unit 17 and main wireless communication unit 19. Radio transmission path 22 for connecting hole 21 and the upper part of controller 18 is provided inside device body 2. Radio transmission path 22 has a duct shape formed by a metal plate forming an outer wall of device body 2 and a metal partition wall different from this metal plate. The partition wall typically has a U-shaped cross section, and radio transmission path 22 is formed in the duct shape by closing an opening that has the U-shaped cross section with the metal plate.

Hole 21 is covered with plastic dielectric cover 23. This hole 21 and radio transmission path 22 form radio transfer section 25.

Next, the operation of cooking device 1 is described. To cook food, which is an object to be heated, the user holds handle 13 provided at the upper part of door 3, and opens opening 5 by pulling door 3. The user then places food inside heating chamber 4 through opening 5, and closes opening 5 of heating chamber 4 by closing door 3.

Then, the user operates one cooking switch 14A for required cooking menu from multiple cooking switches 14A provided on operation unit 14 on handle 13. This outputs a control signal corresponding to cooking switch 14A in the form of wireless signal from door wireless communication unit 17. Output wireless signal passes through a resin frame (not illustrated) provided on door inner wall 9 of door 3, reaches main wireless communication unit 19 through cover 23, hole 21, and radio transmission path 22 in this sequence. Then, main wireless communication unit 19 receives this wireless signal. Main wireless communication unit 19 sends a control signal, which is received wireless signal, to controller 18. Controller 18 outputs a drive signal corresponding to this control signal for controlling driving of the units required for the cooking menu, such as magnetron. As a result, the units required for cooking are driven.

Controller 18 also outputs a range of pieces of information including the time required until completion of cooking or temperature inside heating chamber 4 in the form of a wireless signal. The wireless signal output passes through radio transmission path 22, hole 21, and cover 23 in this sequence, and reaches door wireless communication unit 17. Door wireless communication unit 17 then receives this output wireless signal. A range of pieces of information is extracted from the received wireless signal, and is displayed on display 14B on operation unit 14.

Cooking device 1 as configured above in this exemplary embodiment employs wireless signals for transmission and reception of signals between operation unit 14 with cooking switches 14A and display 14B and controller 18. In other words, no wiring is used for transmitting and receiving signals. Accordingly, signals between operation unit 14 and controller 18 are not affected by noise. This means noise resistance of cooking device 1 improves. In addition, no wiring improves productivity at manufacturing cooking device 1.

If optical communication is used for transmitting and receiving signals, transmission and reception may become difficult by stain on a transmission and reception face of an optical signal coupler. Since signals are transmitted and received using radio waves in cooking device 1 in this exemplary embodiment, there is no influence of stain.

Cooking device 1 in this exemplary embodiment has operation unit 14 at the upper part. Accordingly, operation is easy for desk-top cooking devices in addition to floor-model cooking devices. Still more, operation unit 14 is provided on handle 13 protruding from door 3. This reduces the influence of heat compared to the case of providing operation unit 14 on door 3. In other words, heat resistance of cooking device 1 improves.

Frequency of radio waves used for wireless signals is frequency permitted in each country of use. Cooking device 1 corresponding to a country of use can be manufactured by replacing door 3 to the one with door wireless communication unit 1 that transmits and receives radio waves of permitted frequency.

Still more, operation unit 14 includes object to be heated identification (ID) reader 26. The object to be heated ID reader is, for example, an IC tag in which information including object to be heated type is written in advance. Cooking device 1 that cooks an object to be heated with IC tag as an object to be heated ID is equipped with an IC tag reader as object to be heated ID reader 26. This enables reading of information in the object to be heated ID. Based on this information, the type of object to be heated is automatically identified. This enables appropriate cooking corresponding to each object to be heated.

In addition, a cooking menu can be downloaded from a menu website by linking cooking device 1 and a mobile phone, for example, to access to the Internet. In other words, the use of cooking menu by downloading as required can reduce a memory capacity for cooking menu in cooking device 1. Accordingly, cost of cooking device 1 can be reduced.

Still more, if operation unit 14 is configured with a detachable remote control, and a QR code reader is provided as object to be heated ID reader 26, QR codes listed in an operating manual for cooking device 1 can be read. This can be used for reading the cooking information that is a cooking condition of an object to be heated such as food, and transmitting this information to controller 18. The same operation can be achieved by a combination of bar code and bar code reader, instead of QR code.

Another example of using IC tag, QR code, or bar code as an object to be heated ID is a service for delivering cooked or semi-cooked food to house. More specifically, delivered food can be appropriately cooked without reading instructions by including cooking information required for the delivered food in IC tag, QR code, or bar code in advance.

Furthermore, a remote control with less cooking menus can be used as the remote control where operation unit 14 is provided. This remote control is useful for those who do not use many functions of cooking device 1 (e.g., elders). In other words, this allows the use of cooking device 1 by simple operation, and thus user-friendliness of cooking device 1 improves. In addition, if a cooking menu that each individual often uses, such as warming of milk, is stored in the remote control, user-friendliness of cooking device 1 further improves.

Figure 3:
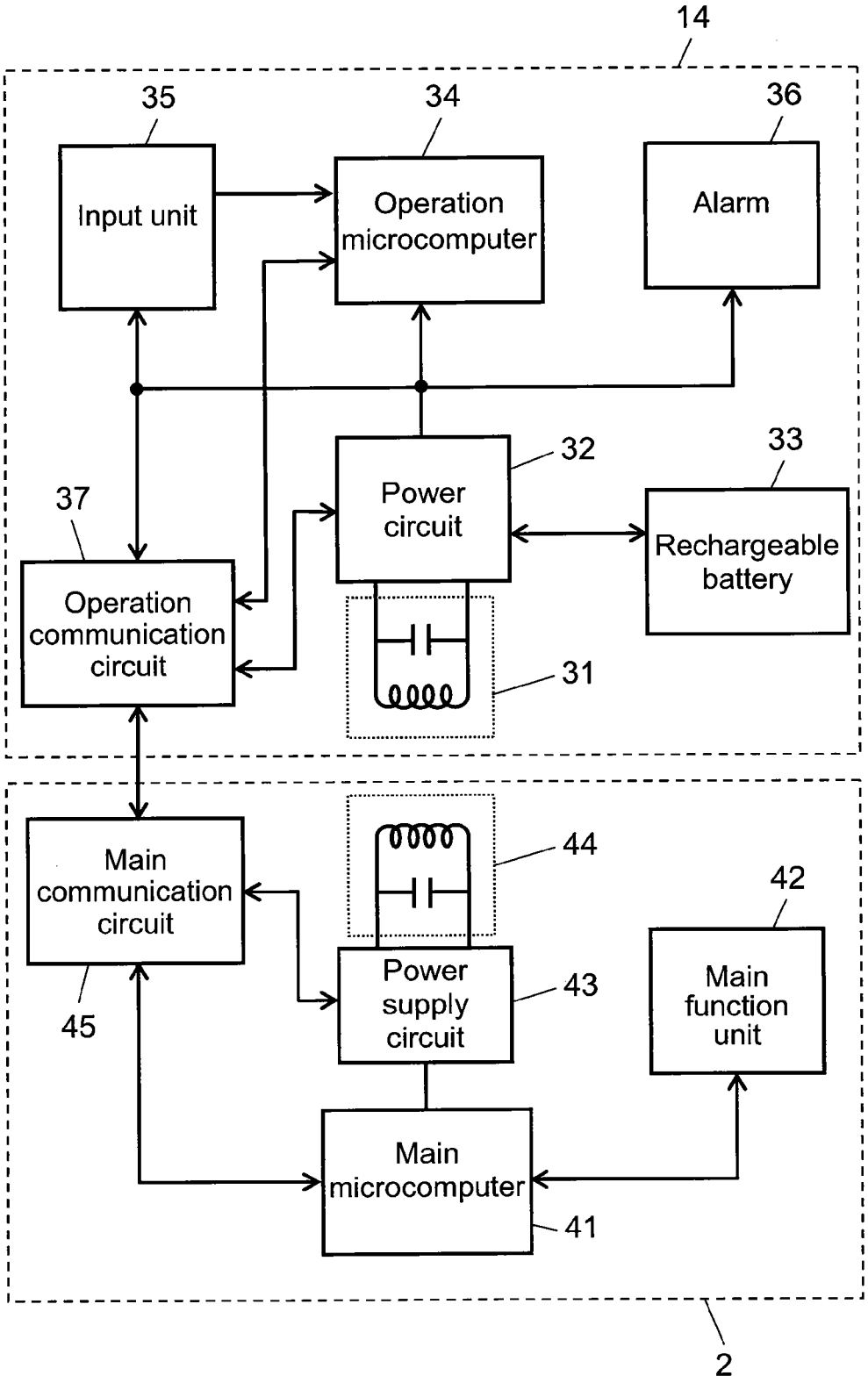
FIG. 3 is a block diagram of the cooking device in the first exemplary embodiment of the present invention.
Figure 4:
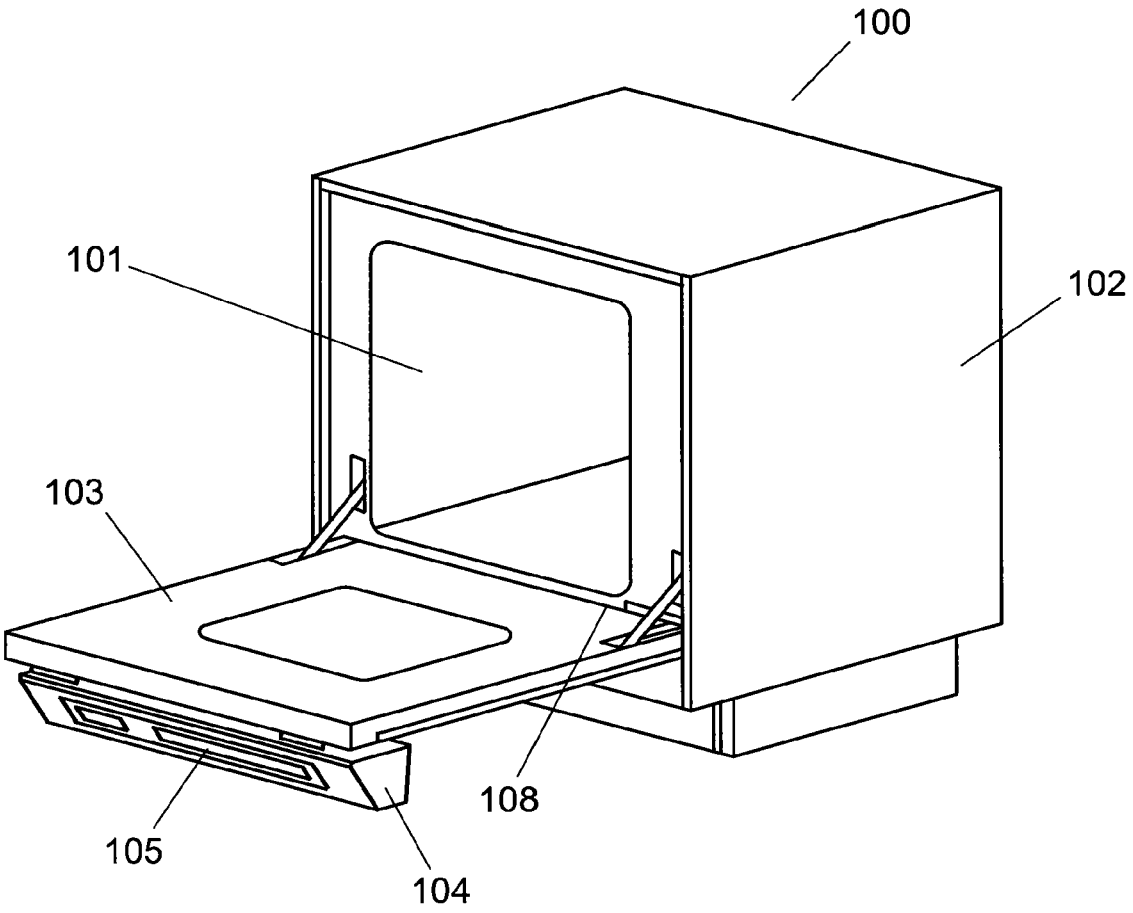
FIG. 4 Prior Art
FIG. 4 is a perspective view of a conventional cooking device.
Figure 5:
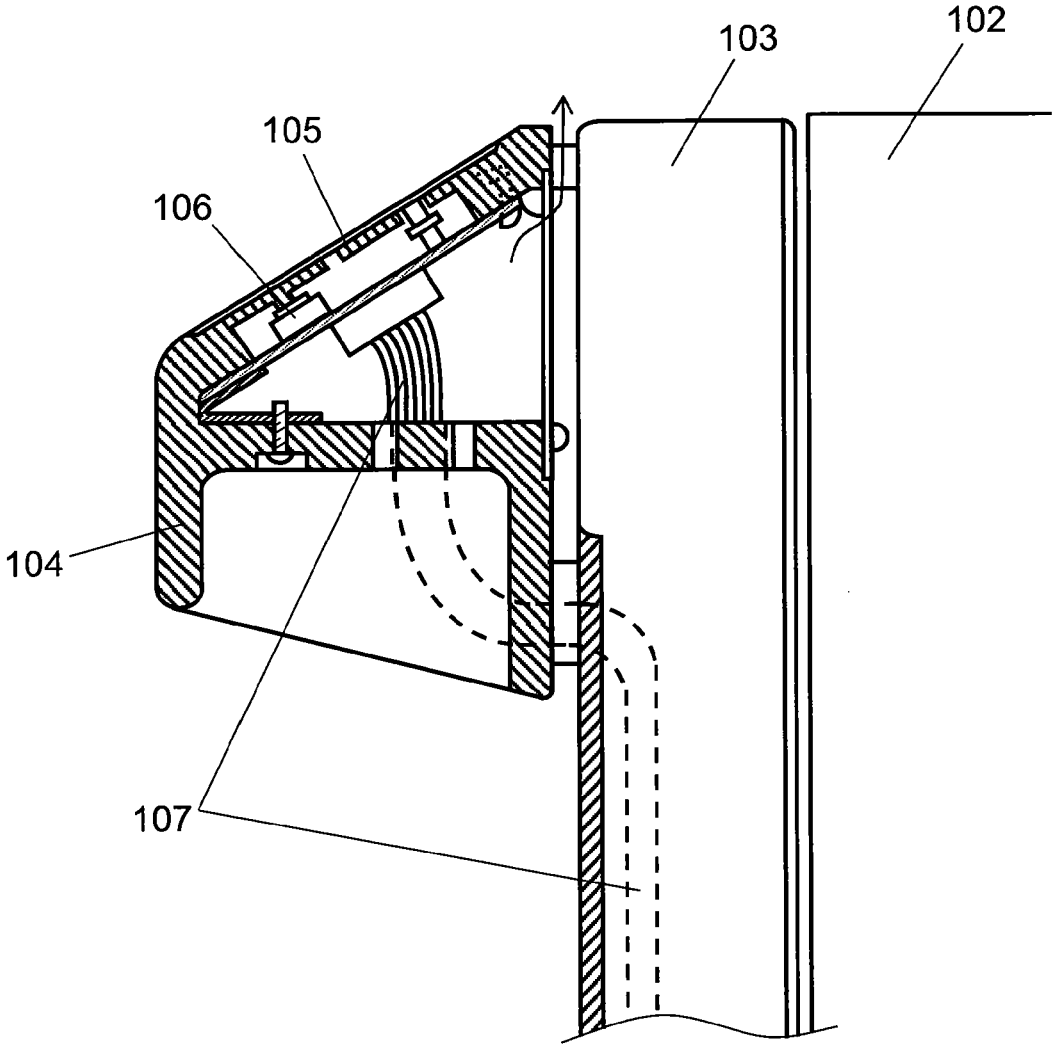
FIG. 5 Prior Art
FIG. 5 is a sectional view of a handle of the conventional cooking device.

In FIG. 3, operation of cooking device 1 and a range of pieces of information are input using operation unit 14. An operation state of cooking device 1 and a response to input are also output and displayed on operation unit 14.

Operation unit 14 includes input unit 35, alarm 36, operation microcomputer 34, operation resonance circuit 31, power circuit 32, rechargeable battery 33, and operation communication circuit 37. The user uses input unit 35 for giving instructions to cooking device 1. Alarm 36 notifies the operation state of cooking device 1 and information such as on any abnormality. Operation microcomputer 34 controls the entire operation unit 14. Operation microcomputer 34 controls, for example, an input signal received from input unit 35, output information output to alarm 36, and operation communication circuit 37. Operation resonance circuit 31 includes an inductor and capacitor. Operation resonance circuit 31 receives power from device body 2 through power supply circuit 43, which is described later. Power circuit 32 receives power supply via operation resonance circuit 31, and supplies power to operation unit 14, more particularly to operation microcomputer 34, input unit 35, alarm 36, and operation communication circuit 37. Rechargeable battery 33 is, for example, a secondary battery, and power is input and output via power circuit 32. In other words, power stored in rechargeable battery 33 is supplied to operation microcomputer 34 and so on. Operation communication circuit 37 transmits and receives signals to and from main communication circuit 45, which is described later. Operation communication circuit 37 typically includes door wireless communication unit 17.

Device body 2 includes main microcomputer 41, main function unit 42, main communication circuit 45, power supply circuit 43, and main resonance circuit 44. Main function unit 42 includes magnetron 24, heater 7 and so on. Main microcomputer 41 controls main function unit 42, main communication circuit 45, and power supply circuit 43. Main communication circuit 45 transmits and receives signals to and from operation communication circuit 37. This enables transmission and reception of information between device body 2 and operation unit 14. Main communication circuit 45 is typically equipped with main wireless communication unit 19. Power supply circuit 43 supplies power to main resonance circuit 44. Main resonance circuit 44 includes an inductor and a capacitor. Main resonance circuit 44 is provided at a position facing operation unit 14. More specifically, main resonance circuit 44 is provided at a position facing operation resonance circuit 31. This configuration enables supply of power from main resonance circuit 44 to operation resonance circuit 31. Accordingly, power supplied from power supply circuit 43 reaches power circuit 32.

Next is given specific configurations for input unit 35. Cooking switch 14A is an example of input unit 35. Input unit 35 is, for example, configured with a mechanical switch such as a push switch and tact switch.

Input unit 35 is, for example, configured with a touch panel. If a touch panel with liquid crystal display (hereafter referred to as LCD) is used, input unit 35 is also used as alarm 36.

Input unit 35 is, for example, configured with a voice input unit. If the voice input unit is used as input unit 35, the user can operate cooking device 1 by voice even if the user is in a state not accessible to operation unit 14.

Input unit 35 is, for example, configured with a sensor. A sensor is a temperature sensor, humidity sensor, illumination sensor, acceleration sensor, magnetic sensor, human-presence sensor, and so on. If aforementioned mechanical switch, touch panel, or voice input unit is used as input unit 35, the user gives an instruction to cooking device 1. On the other hand, if a sensor is used as input unit 35, cooking device 1 operates by itself after detecting information required for cooking from the sensor. Aforementioned input unit 35 may be configured as required with consideration to functions, use environment, use state, and cost of cooking device 1.

Next is given specific configurations for alarm 36. Display 14B is an example of alarm 36. Alarm 36 is, for example, configured with an LCD using cholesteric liquid crystal. Since the LCD can display textual information, content of alarm can be easily recognized. In other words, alarm 36 lets the user know by a sense of sight.

Alarm 36 is, for example, configured with a sound generator such as a speaker. The sound generator outputs beeping sound, melody, linguistic sound in the form of audio signal. In other words, alarm 36 lets the user know by a sense of hearing.

Alarm 36 is, for example, configured with a vibrator such as vibration motor. In other words, alarm 36 lets the user know by a sense of touch. Aforementioned alarm 36 may be configured as required with consideration to functions, use environment, use state, and cost of cooking device 1.

Operation resonance circuit 31 is provided in operation unit 14. Operation resonance circuit 31 and main resonance circuit 44 are disposed facing each other or deviated from each other at an angle. This makes operation resonance circuit 31 and main resonance circuit 33 coupled by electromagnetic induction, and power is supplied from main resonance circuit 44 to operation resonance circuit 31. Inductance and capacitance values of operation resonance circuit 31 are set to values that causes resonance of operation resonance circuit 31 in response to frequency of current that power supply circuit 43 feeds to the inductor of main resonance circuit 44.

Power circuit 32 rectifies and smoothes AC power obtained from operation resonance circuit 31 so as to convert to DC power. Power circuit 32 outputs power converted to DC current to rechargeable battery 33. This makes rechargeable battery 33 charged. Charged DC power is output from rechargeable battery 33 to power circuit 32 as required. DC power from rechargeable battery 33 is converted to a predetermined voltage typically by a regulator, and supplied to operation unit 14 including operation microcomputer 34 as power source.

As described above, main resonance circuit 44 and operation resonance circuit 31 supply power from device body 2 to operation unit 14. Main communication circuit 45 and operation communication circuit 37 transmits and receives communication signals. In other words, FIG. 3 shows configuration in which a resonance circuit for power supply and a resonance circuit for communication (i.e., communication circuit) are separately provided.

Other than the configuration shown in FIG. 3, a resonance circuit for power supply and a resonance circuit for communication may be shared. As described above, main resonance circuit 44 and operation resonance circuit 31 are used for supplying power from main resonance circuit 44 to operation resonance circuit 31. Main communication circuit 45 modulates a communication signal, which is information from main microcomputer 41, and transmits it from main resonance circuit 44 to operation resonance circuit 31 by electromagnetic induction. Operation communication circuit 37 demodulates the communication signal received by operation resonance circuit 31, and transmits it to operation microcomputer 34. In this way, the communication signal is sent from device body 2 to operation unit 14. To send the communication signal from operation unit 14 to device body 2, the above operation is executed in a reverse direction. A modulation system applied to the communication signal is, for example, the amplitude shift keying (ASK) system, phase shift keying (PSK) system, frequency shift keying (FSK) system, and quadrature amplitude modulation (QAM) system.

If main microcomputer 41 determines that operation unit 14 is not at a position facing main resonance circuit 44 at supplying power from power supply circuit 43 to main resonance circuit 44, main microcomputer 41 stops supplying power. Main microcomputer 41 determines that operation unit 14 is not at a position facing main resonance circuit 44 if a predetermined voltage and current values are not obtained at supplying power from power supply circuit 43 to main resonance circuit 44. After stopping power supply, main microcomputer 41 detects the presence of operation unit 14 again at predetermined time intervals. If the presence of operation unit 14 is detected, main microcomputer 41 restarts power supply.

The above configuration enables non-contact communication and power supply without using electrical wiring between operation unit 14 and device body 2. Accordingly, operation unit 14 can be separated from cooking device 1. In this case, operation unit 14 is detachably attached at the upper part of door 3. Operation unit 14 can thus be removed from door 3 for use.

Still more, a battery does not need to be replaced because power is supplied to operation unit 14 from device body 2, and also power is stored in the rechargeable battery. This allows a sealed structure for operation unit 14. The sealed structure is, for example, a structure sealed by resin. Operation unit 14 separated from cooking device 1 can thus achieve a water-proof structure. In addition, if operation unit is configured with resin with high heat conductivity, heat generated from internal circuits can be released using the entire operation unit. Radiation performance of operation unit 14 thus improves.

As described above, operation unit 14 achieves non-contact communication and power supply without using electrical wiring. This enables the use of operation unit 14 separately from cooking device 1 as a remote control. In this case, operation unit 14 used as the remote control uses rechargeable battery 33 for power source.

When operation unit 14 is mounted at a predetermined position of door 3 on cooking device 1, terminal voltage of rechargeable battery 3 is measured. If measured terminal voltage is less than a standard value, rechargeable battery 33 is charged. Noncontact charging is used for charging rechargeable battery 33, which is same as that in the first exemplary embodiment.

Communication takes place between operation unit 14 and device body 2, and device body 2 executes authentication for permitting power supply to operation unit 14. Operation unit 14 executes authentication for permitting power supply from device body 2. In other words, if any abnormality occurs in rechargeable battery 33, authentication fails, and thus no charging takes place. This suppresses unrequired power supply, and reduces power consumption. In addition, if a safety device is provided so as to supply power only to an authenticated remote control, power supply due to any close foreign substance, for example, can be prevented.

Furthermore, a display for confirming authentication, such as a light-emitting diode (LED) may be provided on the remote control, which is operation unit 14, or device body 2. This enables display of stoppage of power supply if, for example, door 3 of cooking device 1 is opened after power supply starts. In addition, the display may be used for displaying completion of charging.

INDUSTRIAL APPLICABILITY

The cooking device of the present invention achieves wireless signal transmission and reception between the operation unit and device body. This eliminates wiring, and improves noise resistance and productivity.

The invention claimed is:

1. A cooking device comprising:

a device body with a heating chamber;

a heating unit for heating an object to be heated placed in the heating chamber;

a door for opening and closing an opening of the heating chamber;

an operation unit provided on the door, the operation unit outputting a control signal corresponding to a designated cooking menu;

a door wireless communication unit provided on the door, the door wireless communication unit transmitting the control signal from the operation unit in a form of a wireless signal;

a main wireless communication unit for receiving the wireless signal from the door wireless communication unit, and transmitting the wireless signal in a form of the control signal to a controller for controlling the heating unit;

a processor within the device body; and power transmission circuitry disposed within the device body that includes a power supply circuit and a resonance circuit for transmitting power to power reception circuitry disposed within the operation unit, wherein the processor determines whether the power reception circuitry is capable of receiving power based at least in part on an amount of current that flows from the power supply circuit to the resonance circuit, wherein when the processor within the device body determines that the power reception circuitry in the operation unit cannot receive power based on a decoupling of the resonant circuit within the device body from the power reception circuitry in the operation unit, the processor within the device body is configured to deactivate the power supply circuit of the power transmission circuitry disposed within the device body.

2. The cooking device of claim 1, wherein the operation unit has a display, and the main wireless communication unit transmits the control signal from the controller to the door wireless communication unit in a form of a wireless signal.

3. The cooking device of claim 1, wherein the door has a handle, and the operation unit and the door wireless communication unit are provided on the handle.

4. The cooking device of claim 2, wherein the device body is covered with a metal, and includes a radio transmission section inside for passing a radio wave therethrough.

5. The cooking device of claim 1, wherein the operation unit includes an object to be heated identification reader for reading an object to be heated identification of the object to be heated.

6. The cooking device of claim 1, wherein the operation unit is detachably attached to the door.

7. The cooking device of claim 1, wherein the operation unit comprises a rechargeable battery for supplying power.

8. The cooking device of claim 1, wherein the power reception circuitry includes an operation resonance circuit, and the power transmission circuitry transmits power to the power reception circuitry via electromagnetic induction.

9. The cooking device of claim 8, wherein the power transmission circuit is configured to modulate a power transmission signal for powering the operating unit with a control signal to thereby communicate information to the operation unit.

10. The cooking device of claim 9, wherein the power transmission circuit modulates the power transmission signal with the control signal via a modulation method selected from the group of modulation methods consisting of: amplitude shift keying (ASK), phase shift keying (PSK), frequency shift keying (FSK), and quadrature amplitude modulation (QAM).

11. A cooking device comprising:

a device body with a heating chamber;

a heating unit for heating an object to be heated placed in the heating chamber;

a door for opening and closing an opening of the heating chamber;

an operation unit provided on the door, the operation unit outputting a control signal corresponding to a designated cooking menu;

a door wireless communication unit provided on the door, the door wireless communication unit transmitting the control signal from the operation unit in a form of a wireless signal;

a main wireless communication unit for receiving the wireless signal from the door wireless communication unit, and transmitting the wireless signal in a form of the control signal to a controller for controlling the heating unit;

a processor within the device body; and power transmission circuitry disposed within the device body that includes a power supply circuit and a resonance circuit for transmitting power to power reception circuitry disposed within the operation unit via electromagnetic induction, wherein the power transmission circuit is configured to modulate a power transmission signal for powering the operating unit with a control signal to thereby communicate information to the operation unit, and the processor within the device body is configured to deactivate the power supply circuit of the power transmission circuitry disposed within the device body after determining that that the power reception circuitry in the operation unit cannot receive power based on a decoupling of a resonant circuit of the power transmission circuitry within the device body from the power reception circuitry in the operation unit.

12. The cooking device of claim 11, wherein the power transmission circuit modulates the power transmission signal with the control signal via a modulation method selected from the group of modulation methods consisting of: amplitude shift keying (ASK), phase shift keying (PSK), frequency shift keying (FSK), and quadrature amplitude modulation (QAM).

13. A cooking device according to claim 1, wherein the operation unit operates on power transmitted from the power transmission circuitry disposed within the device body.

* * * * *